US005545048A

United States Patent [19]

Maeda

[11] Patent Number: 5,545,048

[45] Date of Patent: Aug. 13, 1996

[54] WATERPROOF CONNECTOR

[75] Inventor: Akira Maeda, Shizuoka, Japan

[73] Assignee: Yazaki Corporation, Tokyo, Japan

[21] Appl. No.: 326,927

[22] Filed: Oct. 21, 1994

[30] Foreign Application Priority Data

Oct. 21, 1993 [JP] Japan ..... 5-285545

[51] Int. Cl.[6] ..... H01R 13/52

[52] U.S. Cl. ..... 439/273

[58] Field of Search ..... 439/271–277, 439/281–282

[56] References Cited

U.S. PATENT DOCUMENTS

| | | | |
|---|---|---|---|
| 3,976,352 | 8/1976 | Spinner | 439/272 |
| 4,797,116 | 1/1989 | Isohata et al. | 439/274 |
| 5,108,303 | 4/1992 | Maeda et al. | 439/271 |
| 5,334,039 | 8/1994 | Kanda | 439/271 |

FOREIGN PATENT DOCUMENTS

| | | | |
|---|---|---|---|
| 537751 | 4/1993 | European Pat. Off. | 439/271 |

*Primary Examiner*—P. Austin Bradley

*Assistant Examiner*—Jill Demello

*Attorney, Agent, or Firm*—Sughrue, Mion, Zinn, Macpeak & Seas

[57] ABSTRACT

A waterproof connector is provided in which a waterproof packing can be secured quickly and easily to create a water tight seal. The waterproof packing is formed into a frusto-conical configuration and an inner diameter of a rear end thereof is larger than an outer diameter of at least a front end of an inner tubular portion of a female connector housing. The female connector housing includes an outer tubular portion and an inner tubular portion, and terminal receiving chambers are formed in the inner tubular portion. Retaining pawls are formed on an inner surface of the outer tubular portion at a rear end thereof, and openings are formed adjacent to the respective retaining pawls. The outer surface of the inner tubular portion is tapered and decreases in diameter toward the front end thereof, and the waterproof packing is fitted on this outer surface. With this construction, the fitting and securing of the waterproof packing on the inner tubular portion can be effected easily. Also, a front end portion of a male connector housing can be inserted into a gap formed between the outer surface of the waterproof packing and the inner surface of the outer tubular portion so that an electrical connection is made in the waterproof connector.

21 Claims, 3 Drawing Sheets

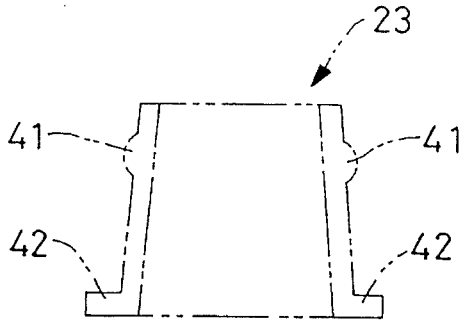
FIG. 5
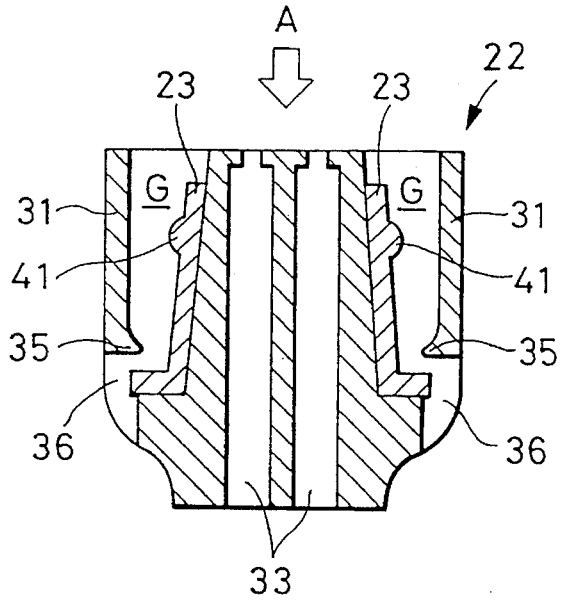
FIG. 6
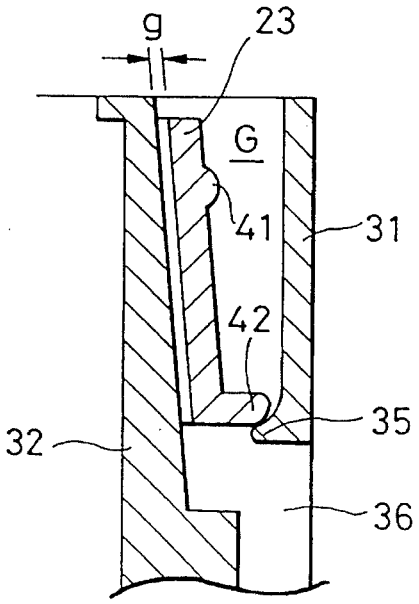
FIG. 7
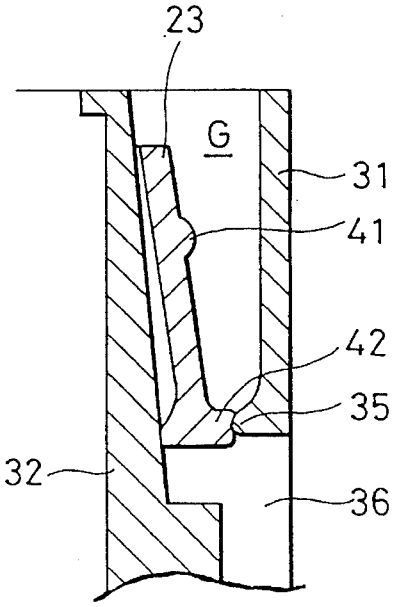

WATERPROOF CONNECTOR

BACKGROUND OF THE INVENTION

This invention relates to a waterproof connector which can be used, for example, in a branch connection of a wire harness of an automobile. More particularly, this invention relates to the construction of a waterproof packing which provides a waterproof connection between a male and a female connector.

FIGS. 9 and 10 show a conventional waterproof connector. A cylindrical connector housing 1, constituting a female connector, includes a cylindrical outer tubular portion 2 and an inner tubular portion 3. The outer tubular portion 2 defines an outer wall of the connector housing 1, and the inner tubular portion has a plurality of terminal receiving chambers 4 which each has an elastic lance 5 therein for retaining a connection terminal (not shown).

When a male connector (not shown) is to be connected to the above female connector, a waterproof packing 11 is fitted around the inner tubular portion 3 of the connector housing 1. Retaining projections 15 formed on a bottom end of the waterproof packing 11 are engaged respectively in retaining holes 7 in the outer tubular portion 2. Subsequently, the cylindrical male connector (not shown) is inserted into a gap formed between the outer surface of the waterproof packing 11 and the inner surface of the outer tubular portion 2 so that the connection terminals of the two connectors are electrically connected together.

In the above-described waterproof connector, the waterproof packing 11 is held tightly around the inner tubular portion 3 in order to prevent water from entering the inner peripheral surface of the waterproof packing 11.

However, in the waterproof connector, fitting the waterproof packing 11 around the inner tubular portion 3 is cumbersome and inefficient. For example, the waterproof packing 11 is made of an elastic material such as rubber and must be tightly fitted around the inner tubular portion 3 of the connector housing 1 in order to form a waterproof seal.

Therefore, the inner diameter of the waterproof packing 11 is made slightly smaller than the outer diameter of the inner tubular portion 3, and the waterproof packing 11 is press-fitted on the inner tubular portion 3. In order to press-fit the waterproof packing 11 on the inner tubular portion 3, the waterproof packing 11 must be pushed inward around the inner tubular portion 3. However, this procedure is inconvenient and difficult.

Also, since the retaining projections 15 are formed at the bottom and of the waterproof packing 11, the retaining projections 15 engage the outer tubular portion 2 and are deformed during the insertion. Consequently, as the packing is pushed inward, friction between the retaining projections 15 and the inner surface of the outer tubular portion 2 make it difficult to insert the waterproof packing 11. Therefore, a large force is required to press-fit the waterproof packing 11, and the connector may not be completely waterproof.

SUMMARY OF THE INVENTION

It is an object of the present invention to provide a waterproof connector in which a waterproof packing can be inserted easily while simultaneously ensuring that the connector is waterproof.

The above object of the present invention has been achieved by a waterproof connector comprising: a first connector housing having an inner tubular portion and an outer tubular portion formed around the inner tubular portion to form a gap therebetween, wherein the inner tubular portion has a plurality of terminal receiving chambers formed therein; a tubular waterproof packing fitted and secured on an outer surface of the inner tubular portion, wherein an outer diameter of at least a front end of the inner tubular portion is smaller than a rear inner diameter of a rear end of the tubular waterproof packing; and a second connector housing fitted in the gap between the outer tubular portion and the tubular waterproof packing.

The above object has also been achieved by a construction in which the outer surface of the inner tubular portion of the first connector housing is tapered such that the outer diameter of the inner tubular portion progressively increases toward a rear end of the inner tubular portion.

The above object has also been achieved by a construction in which the waterproof packing is substantially shaped as a frusto-conical tube, wherein the rear inner diameter of the rear end of the tubular waterproof packing is larger than a front inner diameter of a front end of the tubular waterproof packing.

In a waterproof connector with this construction, securely fitting the waterproof packing around the front end of the inner tubular portion can be carried out smoothly and easily. Also, in the case in which the waterproof packing is retained around the inner tubular portion, a secure fit between the outer surface of the inner tubular portion and the waterproof packing is obtained, and water is prevented from leaking into the connector.

BRIEF DESCRIPTION OF THE DRAWINGS

FIG. 5 is a cross-sectional view of the insertion of the waterproof packing in the female connector housing;

FIG. 6 is a cross-sectional view illustrating the process of inserting the waterproof packing in the female connector housing;

FIG. 7 is a cross-sectional view illustrating the process of securing the waterproof packing in the female connector housing;

DESCRIPTION OF THE PREFERRED EMBODIMENTS

Figure 1:
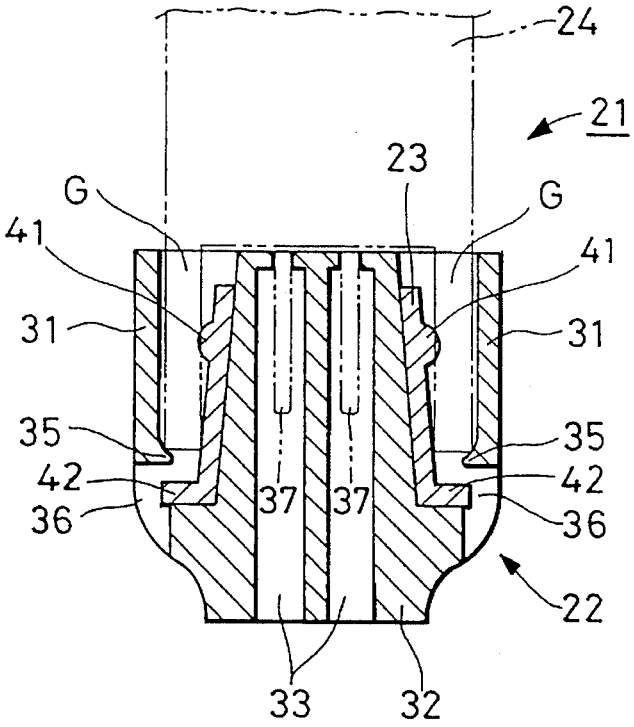
FIG. 1 is a cross-sectional view of the construction of a first embodiment of a waterproof connector of the present invention.

A first embodiment of the present invention will now be described in detail with reference to FIGS. 1 to 7. FIG. 1 is a cross-sectional view showing the construction of the waterproof connector of the present invention. As shown in FIG. 1, the waterproof connector 21 comprises a female connector housing 22, a waterproof packing 23, and a male connector housing 24.

The female connector housing 22 includes an outer tubular portion 31, and an inner tubular portion 32. Terminal receiving chambers 33 are formed in the inner tubular portion 32, and a connection terminal (not shown) is inserted in each of the terminal receiving chambers 33. Also, retaining pawls 35 are formed on an inner surface of the outer tubular portion 31 at a rear end thereof, and openings 36 are respectively formed adjacent to the retaining pawls 35.

An outer surface of the inner tubular portion 32 is tapered and decreases in diameter toward the front end from which the male connector housing 24 is inserted, and the waterproof packing 23 is tightly secured on this tapered surface. The front end portion of the male connector housing 24 is inserted into a gap G between the outer surface of the waterproof packing 23 and the inner surface of the outer tubular portion 31. As a result, connection terminals 37 of the male connector housing 24 are inserted respectively into the terminal receiving chambers 33. Consequently, the connection terminals 33 are electrically connected to the connection terminals (not shown) in the terminal receiving chambers 33.

Figure 2:
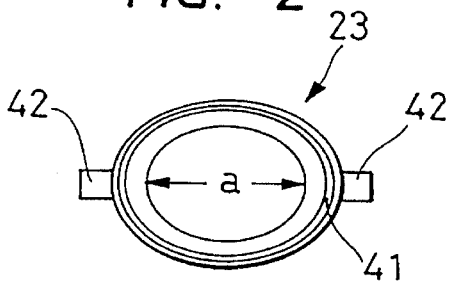
FIG. 2 is a plan view of a waterproof packing of the first embodiment.
Figure 3:
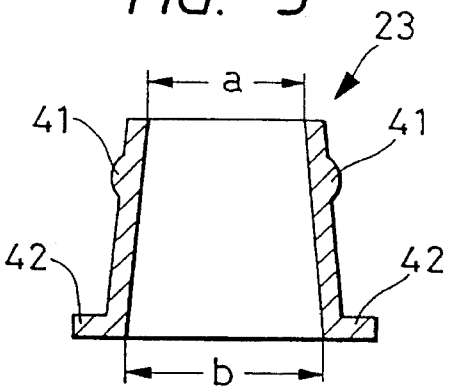
FIG. 3 is a cross-sectional view of the waterproof packing illustrated in FIG. 2.

Next, features of the female connector housing 22 and the waterproof packing 23 will now be described with reference to FIGS. 2 to 4. As shown in FIGS. 2 and 3, the waterproof packing 23 is formed into a tube having an oval cross-section and is tapered from its larger rear end to its smaller front end in a frusto-conical shape. Namely, the long axis b of the diameter of the rear end is larger than the long axis a of the diameter of the front end ($a<b$). An annular convex seal portion 41 is formed on the outer surface of the waterproof packing 23, and a pair of retaining projections 42 are formed on the outer surface of the waterproof packing 23 at the rear and thereof.

Figure 4:
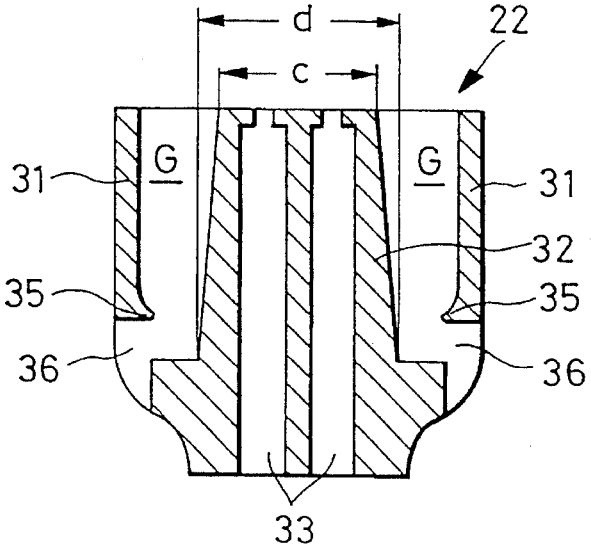
FIG. 4 is a cross-sectional view of the configuration of a female connector housing.

As shown in FIG. 4, the inner tubular portion 32 of the female connector housing 22 is shaped in the form of a tube having an oval cross-section like the waterproof packing 23. The outer surface of the inner tubular portion 32 progressively decreases in thickness towards the front end, thereby creating the tapered outer surface. In other words, the long axis d of the diameter of the rear end is larger than the long axis c of the diameter of the front end ($c<d$). Furthermore, the long axis d of the diameter of the rear end of the inner tubular portion 32 is slightly larger than but approximately equal to the long axis b of the diameter of the rear end of the waterproof packing 23 ($b \approx d$).

As shown in FIG. 5, when the waterproof packing 23 is fitted on the inner tubular portion 32 of the female housing 22, the rear end of the waterproof packing 23 is disposed above the front end of the female connector housing 22. The waterproof packing 23 is positioned above the female connector housing 22 in such a manner that the centers of the oval end surfaces of the waterproof packing 23 and the inner tubular portion 32 are aligned with each other. Then, the waterproof packing 23 is pushed into the female connector housing 22 in a direction of arrow A. Since the long axis b of the diameter of the rear end of the waterproof packing 23 is always larger than the long axis c of the diameter of the front end of the inner tubular portion 32 ($b>c$), the insertion can be effected quite easily. Also, since the waterproof packing 23 and the inner tubular portion 32 are both oval shape and the waterproof packing 23 is inserted when the center of its oval end surface is aligned with that of the inner tubular portion 32, the retaining projections 42 can be easily positioned with respect to the openings 36. Consequently, when the waterproof packing 23 is further pushed inward, the waterproof packing 23 is securely fitted around the inner tubular portion 32.

An shown in FIG. 6, in the process of securing the waterproof packing 23 on the inner tubular portion 32, the long axis b of the diameter of the rear end of the waterproof packing 23 is larger than the long axis c of the diameter of the front end of the inner tubular portion 32 ($b>c$). Therefore, a gap g is formed between the outer surface of the inner tubular portion 32 and the inner surface of the waterproof packing 23. As a result, the waterproof packing 23 can be inserted without any resistance until the gap g disappears.

As shown in FIG. 7, the retaining projections 42 engage the retaining pawls 35 while the gap g still exists, and thus, the retaining projections 42 are easily deformed by the retaining pawls 35. Consequently, when pushing the waterproof packing 23 inward, the retaining projections 42 pass past the respective retaining pawls 35 and reach the respective openings 36 so that the waterproof packing 23 is securely fitted onto the inner tubular portion 32.

When the waterproof packing 23 is retained on the inner tubular portion 32, the long axis b of the diameter of the rear end of the waterproof packing 23 is approximately equal to the long axis d of the diameter of the rear end of the inner tubular portion 32 ($b \approx d$). Therefore, the rear end of the waterproof packing 23 is held tightly around the rear end of the inner tubular portion 32. Also, the front end of the waterproof packing 23 is disposed on the tapered surface of the inner tubular portion 32 and is held tightly around the outer surface of the inner tubular portion 32. Therefore, the waterproof packing 23 is held in water-tight contact with the outer surface of the inner tubular portion 32.

Furthermore, as shown in FIG. 1, the male connector housing 24 is inserted so as to be fitted on the outer surface of the waterproof packing 23, and the inner edge of the front end of the male connector housing 24 engages the curved surfaces of the retaining pawls 35 so as to force the outer surface of the waterproof packing 23 toward the inner tubular portion 32. In addition, the male connector housing 24 presses the seal portion 41 against the inner tubular portion 32 to form a water-tight seal. Therefore, by interposing the waterproof packing 23 of a frusto-conical shape between the inner tubular portion 32 and the male connector housing 24, the female connector housing 22 and the male connector housing 24 can be connected together in a waterproof manner.

In addition, since the waterproof packing 23 is formed into a frusto-conical shape and the inner tubular portion 32 is formed into a tapering configuration, the insertion and securing of the waterproof packing 23 in the female connector housing 22 is easy. Thus, the waterproof packing 23 can be secured around the inner tubular portion 32 easily and efficiently.

Figure 8:
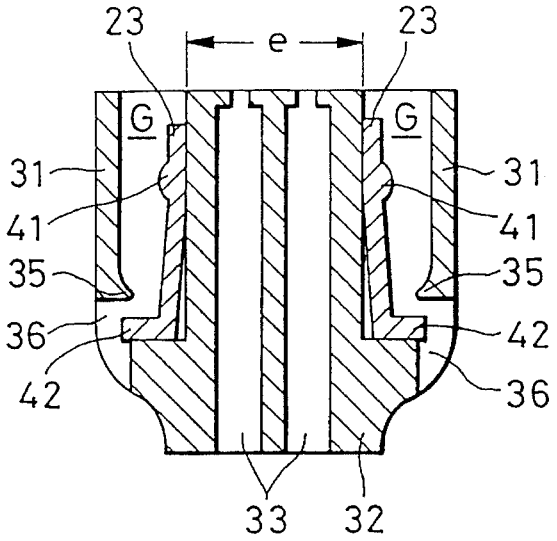
FIG. 8 is a cross-sectional view of a second embodiment of a waterproof connector that has been inserted in a female connector housing.
Figure 9:
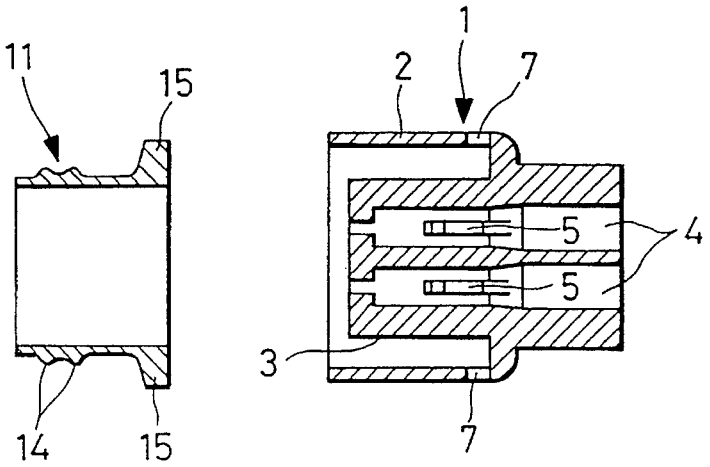
FIG. 9 is a cross-sectional view of a conventional waterproof connector and a conventional female connector housing.
Figure 10:
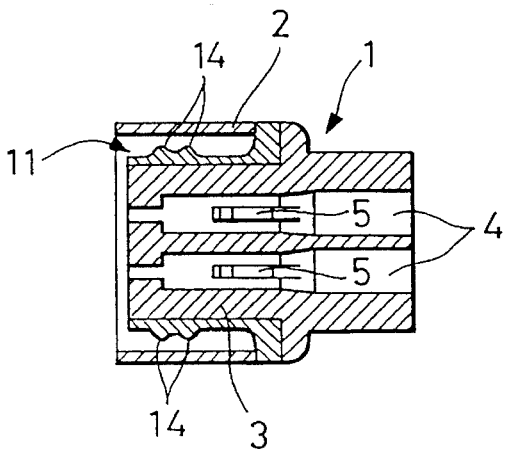
FIG. 10 is a cross-sectional view of the conventional waterproof packing inserted in the conventional female housing.

Next, a second embodiment of the present invention will now be described with reference to FIG. 8. In this embodiment, although a waterproof packing 23 has the same configuration as that of the packing of the first embodiment, an outer surface of an inner tubular portion 32 is not tapered. However, the long axis b of the diameter of the rear end of the waterproof packing 23 is larger than the long axis of e of the diameter of the front end of the inner tubular portion 32. Also, the long axis a of the diameter of the front end of the waterproof packing 23 is smaller that the long axis e.

Therefore, the waterproof packing 23 can be inserted halfway along the inner tubular portion 32 without any resistance, and after the waterproof packing 32 is partially inserted, the waterproof packing 23 must be press-fitted.

When the waterproof packing 23 is securely fitted in place, the front end of the waterproof packing 23 is pressed against the outer surface of the inner tubular portion 32, and a water-tight seal is formed. Furthermore, upon insertion of the male connector housing 24, the rear end portion of the waterproof packing 23 is pressed against the inner tubular portion 32, and the male connector housing 24 presses a seal portion 41 against the inner tubular portion 32 as in the first embodiment. Consequently, the water-tight seal is further improved.

In the construction of this embodiment, the waterproof packing 23 can be easily and securely fitted on the female connector housing 22. Also, the female connector housing 22 and the male connector housing 24 can be quickly and efficiently be connected together in a waterproof manner.

Furthermore, the present invention in not limited to the above embodiments. In the above embodiments, although the waterproof packing 23, the male connector housing 24, and the female connector housing 22 are of an oval configuration, they may be of a cylindrical configuration, a cross-sectionally square configuration, a tubular configuration, or other various configurations. The male connector housing 24 and the female connector housing 22 may also be reversed so that the waterproof packing 23 is fitted around the male connector housing 24. In addition, the number of the retaining projections is not limited to two, and a flange-like retaining projection may be formed in the waterproof packing to correspond to an annular opening and an annular retaining pawl which may be formed in the female connector housing.

As described above, in the waterproof connector 21 of the present invention, the waterproof packing 23 is formed into a frusto-conical shape, and the inner diameter of the rear end of the waterproof packing 23 is larger than the outer diameter of at least the front end of the inner tubular portion 32 of the first connector housing which retains the waterproof packing 23.

Therefore, when the waterproof packing 23 is to be secured around the inner tubular portion 32, the waterproof packing 23 can be easily inserted and fitted on the inner tubular portion 32. Also, when the waterproof packing is secured by inserting it a predetermined amount, the front end portion is held tightly against the outer surface of the inner tubular portion 32 so that a water-tight seal is formed. Therefore, the first and second connector housings can be connected together in a waterproof manner.

What is claimed is:

1. A waterproof connector comprising:

a first connector housing having an inner tubular portion and an outer tubular portion formed around said inner tubular portion to form a gap therebetween, wherein said inner tubular portion has a plurality of terminal receiving chambers formed therein; and a tubular waterproof packing fitted and secured on an outer surface of said inner tubular portion, wherein an outer diameter of at least a front end of said inner tubular portion is smaller than a rear inner diameter of a rear end of said tubular waterproof packing, and wherein an inner surface of said tubular waterproof packing is tapered such that said rear inner diameter is greater than a front inner diameter of a front end of said tubular waterproof packing.

2. The waterproof connector according to claim 1, wherein said outer surface of said inner tubular portion is tapered such that said outer diameter of said inner tubular portion progressively increases towards a rear end of said inner tubular portion.

3. The waterproof connector according to claim 1, wherein said inner tubular portion has a shape substantially like a right cylinder such that said outer diameter of said inner tubular portion is substantially constant.

4. The waterproof connector according to claim 1, in which said tubular waterproof packing is substantially shaped as a frusto-conical tube, wherein said rear inner diameter of said rear end of said tubular waterproof packing is larger than said front inner diameter of said front end of said tubular waterproof packing.

5. The waterproof connector according to claim 1, wherein said tubular waterproof packing further comprises at least one retaining projection which respectively projects through at least one opening in said outer tubular portion in order to further secure said tubular waterproof packing around said inner tubular portion.

6. The waterproof connector according to claim 1, wherein said tubular waterproof packing has an oval cross-section.

7. The waterproof connector according to claim 1, further comprising:

a second connector housing fitted in the gap between said outer tubular portion and said tubular waterproof packing.

8. The waterproof connector according to claim 7, wherein said tubular waterproof packing further comprises a seal portion which is pressed against said outer surface of said inner tubular portion by said second connector housing.

9. A waterproof connector comprising:

a first connector housing having an inner tubular portion and an outer tubular portion formed around said inner tubular portion to form a gap therebetween, wherein said inner tubular portion has a plurality of terminal receiving chambers formed therein and wherein said inner tubular portion has an outer surface which is tapered such that an outer diameter of said inner tubular portion progressively decreases towards a front end of said inner tubular portion;

a tubular waterproof packing fitted and secured on said outer surface of said inner tubular portion, wherein said outer diameter of at least said front end of said inner tubular portion is smaller than a rear inner diameter of a rear end of said tubular waterproof packing, wherein said tubular waterproof packing is substantially shaped as a frusto-conical tube, wherein said rear inner diameter of said rear end of said tubular waterproof packing is larger than a front inner diameter of a front end of said waterproof packing, and wherein said tubular waterproof packing further comprises at least one retaining projection which respectively projects through at least one opening in said outer tubular portion in order to further secure said waterproof packing around said inner tubular portion; and a second connector housing fitted in the gap between said outer tubular portion and said tubular waterproof packing, wherein said tubular waterproof packing further comprises a seal portion which is pressed against said outer surface of said inner tubular portion by said second connector housing.

10. A waterproof connector comprising:

a first connector housing having an inner tubular portion and an outer tubular portion formed around said inner tubular portion to form a gap therebetween, wherein said inner tubular portion has a plurality of terminal receiving chambers formed therein; and a tubular waterproof packing fitted and secured on an outer surface of said inner tubular portion, wherein an outer diameter of at least a front end of said inner tubular portion is smaller than a rear inner diameter of a rear end of said tubular waterproof packing and wherein said outer surface of said inner tubular portion is tapered such that said outer diameter of said inner tubular portion progressively increases towards a rear end of said inner tubular portion.

11. The waterproof connector according to claim 10, in which said tubular waterproof packing is substantially shaped as a frusto-conical tube, wherein said rear inner diameter of said rear end of said tubular waterproof packing is larger than a front inner diameter of a front end of said tubular waterproof packing.

12. The waterproof connector according to claim 10, wherein said tubular waterproof packing further comprises at least one retaining projection which respectively projects through at least one opening in said outer tubular portion in order to further secure said tubular waterproof packing around said inner tubular portion.

13. The waterproof connector according to claim 10, wherein said tubular waterproof packing has an oval cross-section.

14. The waterproof connector according to claim 10, further comprising:

a second connector housing fitted in the gap between said outer tubular portion and said tubular waterproof packing.

15. The waterproof connector according to claim 14, wherein said tubular waterproof packing further comprises a seal portion which is pressed against said outer surface of said inner tubular portion by said second connector housing.

16. A waterproof connector comprising:

a first connector housing having an inner tubular portion and an outer tubular portion formed around said inner tubular portion to form a gap therebetween, wherein said inner tubular portion has a plurality of terminal receiving chambers formed therein; and a tubular waterproof packing fitted and secured on an outer surface of said inner tubular portion, wherein an outer diameter of at least a front end of said inner tubular portion is smaller than a rear inner diameter of a rear end of said tubular waterproof packing and wherein said outer diameter of said inner tubular portion is substantially tapered between said front end of said inner tubular portion and a rear end of said inner tubular portion.

17. A waterproof connector comprising:

a first connector housing having an inner tubular portion and an outer tubular portion formed around said inner tubular portion to form a gap therebetween, wherein said inner tubular portion has a plurality of terminal receiving chambers formed therein;

a tubular waterproof packing fitted and secured on an outer surface of said inner tubular portion, wherein an outer diameter of at least a front end of said inner tubular portion is smaller than a rear inner diameter of a rear end of said tubular waterproof packing and wherein said outer diameter of said inner tubular portion is substantially constant between said front end of said inner tubular portion and a rear end of said inner tubular portion; and a second connector housing fitted in the gap between said outer tubular portion and said tubular waterproof packing.

18. The waterproof connector according to claim 17, wherein said tubular waterproof packing further comprises a seal portion which is pressed against said outer surface of said inner tubular portion by said second connector housing.

19. A waterproof connector comprising:

a first connector housing having an inner tubular portion and an outer tubular portion formed around said inner tubular portion to form a gap therebetween, wherein said inner tubular portion has a plurality of terminal receiving chambers formed therein; and a tubular waterproof packing fitted and secured on an outer surface of said inner tubular portion, wherein an outer diameter of at least a front end of said inner tubular portion is smaller than a rear inner diameter of a rear end of said tubular waterproof packing and wherein said outer diameter of said inner tubular portion is substantially constant between said front end of said inner tubular portion and a rear end of said inner tubular portion, wherein said tubular waterproof packing is substantially shaped as a frusto-conical tube and wherein said rear inner diameter of said rear end of said tubular waterproof packing is larger than a front inner diameter of a front end of said tubular waterproof packing.

20. A waterproof connector comprising:

a first connector housing having an inner tubular portion and an outer tubular portion formed around said inner tubular portion to form a gap therebetween, wherein said inner tubular portion has a plurality of terminal receiving chambers formed therein; and a tubular waterproof packing fitted and secured on an outer surface of said inner tubular portion, wherein an outer diameter of at least a front end of said inner tubular portion is smaller than a rear inner diameter of a rear end of said tubular waterproof packing and wherein said outer diameter of said inner tubular portion is substantially constant between said front end of said inner tubular portion and a rear end of said inner tubular portion, wherein said tubular waterproof packing further comprises at least one retaining projection which respectively projects through at least one opening in said outer tubular portion in order to further secure said tubular waterproof packing around said inner tubular portion.

21. A waterproof connector comprising:

a first connector housing having an inner tubular portion and an outer tubular portion formed around said inner tubular portion to form a gap therebetween, wherein said inner tubular portion has a plurality of terminal receiving chambers formed therein; and a tubular waterproof packing fitted and secured on an outer surface of said inner tubular portion, wherein an outer diameter of at least a front end of said inner tubular portion is smaller than a rear inner diameter of a rear end of said tubular waterproof packing and wherein said outer diameter of said inner tubular portion is substantially constant between said front end of said inner tubular portion and a rear end of said inner tubular portion, wherein said tubular waterproof packing has an oval cross-section.

* * * * *